United States Patent [19]

Jones et al.

[11] Patent Number: 4,588,514

[45] Date of Patent: May 13, 1986

[54] LIQUID THICKENED BLEACHING COMPOSITION

[75] Inventors: Frank Jones, Dielheim, Fed. Rep. of Germany; David A. Reed, Irby, Great Britain; Jane A. Crompton, Tranmere, Great Britain; Pedro M. Beramendi, Buenos Aires, Argentina

[73] Assignee: Lever Brothers Company, New York, N.Y.

[21] Appl. No.: 651,729

[22] Filed: Sep. 19, 1984

[30] Foreign Application Priority Data

Sep. 23, 1983 [GB] United Kingdom ..... 8325541

[51] Int. Cl.[4] ..... C11D 3/395; C11D 7/52

[52] U.S. Cl. ..... 252/98; 252/96; 252/102; 252/103; 252/156; 252/527; 252/531; 252/546; 252/550; 252/DIG. 14; 252/108

[58] Field of Search ..... 252/96, 98, 102, 103, 252/108, DIG. 14, 527, 531, 546, 550

[56] References Cited

U.S. PATENT DOCUMENTS 4,388,204 6/1983 Dimond et al. ..... 252/98

FOREIGN PATENT DOCUMENTS

| | | |
|---|---|---|
| 21581 | 1/1981 | European Pat. Off. . |
| 30401 | 6/1981 | European Pat. Off. . |
| 74134 | 3/1983 | European Pat. Off. . |
| 110544 | 6/1984 | European Pat. Off. . |
| 1466560 | 2/1974 | United Kingdom . |
| 2051162 | 1/1981 | United Kingdom . |
| 2076010 | 11/1981 | United Kingdom . |

*Primary Examiner*—Paul Lieberman
*Assistant Examiner*—John F. McNally
*Attorney, Agent, or Firm*—Milton L. Honig; James J. Farrell

[57] ABSTRACT

Thickened, pourable liquid bleaching compositions which have been thickened with the aid of two different detergent-active materials, e.g. a tertiary amine oxide with a saturated fatty acid soap or an alkali metal sarcosinate often show a decrease in viscosity on storage of the composition.

By inclusion of a third, synthetic detergent of the sulphate or sulphonate type, e.g. an alkylethersulphate, compositions are obtained with a significantly reduced decrease of viscosity during storage, particularly over longer periods and at higher storage temperatures.

The compositions are useful for bleaching hard surfaces.

1 Claim, No Drawings

LIQUID THICKENED BLEACHING COMPOSITION

The present invention relates to improved liquid, thickened bleaching compositions, based on an aqueous alkali metal hypochlorite solution.

Liquid, pourable thickened bleaching compositions, based on an aqueous alkali metal hypochlorite solution which has been thickened to a certain viscosity by inclusion therein of a thickening system are nowadays well known on the market. Various thickening systems have been described in the art for inclusion in aqueous alkali metal hypochlorite solutions; these systems usualy consist of a mixture of two different detergent-active materials (cf. our EP-A1-0030401). Examples of such mixtures are tertiary amine oxides with saturated fatty acid soaps (GB-A-1 329 086); betaines with saturated fatty acid soaps (GB-A-1 329 086); sucrose esters with quaternary ammonium compounds or tertiary amine oxides or betaines or alkanolamides (GB-A-1 548 379); sarcosinates or taurides with a fatty acid soap or a quaternary ammonium compound or a tertiary amine oxide or a betaine or an alkanolamide (GB-A-1 466 560); branched chain tertiary amine oxides with fatty acid soaps (GB-A1-2 003 522); tertiary amine oxides with alkylsulphates (GB-A1-2 051 162); carboxylated nonionics with fatty acid soaps or sarcosinates or taurides or tertiary amine oxides or betaines or alkanolamides or alkylethersulphates or sucrose esters or alkylsulphates (GB-A1-2 076 010); phosphated, optionally alkoxylated, fatty acid alkanolamides with tertiary amine oxides or betaines or an alkylphosphate or an alkyletherphosphate (GB-A1-2 046 321).

Many thickening systems have thus been proposed and several of these are used commercially, such as mixtures of tertiary amine oxides and saturated fatty acid soaps, mixtures of tertiary amine oxides and alkoylsarcosinates, mixtures of tertiary amine oxides and alkylethersulphates.

In the formulation of thickened, pourable aqueous alkali metal hypochlorite compositions the shelf life of the product plays an important role. Not only should the product have a satisfactory chlorine stability during storage, but also a physical stability in terms of cloud point and viscosity. Particularly the viscosity stability is important in that a viscosity decrease during storage may make the product less attractive to the consumer.

Most of the above thickening systems when included in an aqueous alkali metal hypochlorite composition yield thickened products, the viscosity of which decreases with increased storage time. This decrease of the product viscosity is accelerated if the storage temperature increases.

It is therefore an object of the present invention to provide liquid, pourable thickened bleaching compositions on the basis of an aqueous alkali metal hypochlorite composition with an improved viscosity stability during storage.

It has now surprisingly been found that the use of a ternary active detergent mixture as thickening system for aqueous alkali metal hypochlorite compositions provides thickened liquid pourable products with a significantly improved viscosity stability over longer storage periods and at increased storage temperatures.

The ternary active detergent mixture comprises a binary active detergent mixture which, when used alone, would produce a thickened liquid bleach product with a decreasing viscosity on storage, together with an anionic synthetic active detergent of the sulphate or sulphonate type.

Consequently, in its broadest aspects the present invention relates to liquid, pourable thickened bleaching compositions, based on an aqueous alkali metal hypochlorite solution which has been thickened by inclusion therein of a mixture of different detergent-active materials, and is characterized in that the mixture of different detergent-active materials comprises a binary mixture of different detergent-active materials which when used as thickening system yields a thickened product, the viscosity of which decreases on storage of the product, together with a third, synthetic detergent-active material of the sulphate or sulphonate type.

Binary mixtures of different detergent-active materials which when used as thickening system in aqueous alkali metal hypochlorite solutions produce a thickened product with a decaying viscosity on prolonged storage are most of the binary systems referred to above in the discussion of the prior art. Typically, such binary mixtures are mixtures of tertiary amine oxides with soaps or with sarcosinates or with alkanolamides or with quaternary ammonium compounds or with sugar esters etc. Preferably, a mixture of a tertiary amine oxide of the formula $R_1R_2R_3N—O$ in which $R_1$=a $C_8$–$C_{20}$ branched- or straight-chain alkyl group and $R_2$ and $R_3$ are $C_1$–$C_4$ branched- or straight-chain alkyl groups, with a sodium soap of a saturated $C_8$–$C_{18}$ fatty acid or an alkali metal sarcosinate $R_4CON(CH_3)COOM$, in which $R_4$ is a branched- or straight-chain $C_{10}$–$C_{18}$ alkyl group and M is an alkali metal cation, is used.

The third, synthetic detergent-active material in the ternary mixture of detergent-active materials of the invention is an anionic synthetic detergent of the sulphate or sulphonate type. Typically, such anionic synthetic detergents include $C_6$–$C_{18}$ branched- or straight-chain alkylsulphates, $C_8$–$C_{22}$ branched- or straight-chain alkylethersulphates containing from 1 to 10 moles of ethylene oxide, propylene oxide or mixtures thereof in the ether moiety, $C_8$–$C_{18}$ primary or secondary alkane sulphonates, $C_{10}$–$C_{18}$ alkylbenzenesulphonates and other well-known anionic synthetic detergents of the sulphate and sulphonate type, examples of which are amply described in Schwartz-Perry-Berch "Surface Active Agents and Detergents, Vol. I (1949) and Vol. II (1958).

The preferred anionic synthetic detergents are the $C_8$–$C_{22}$ branched- or straight-chain alkylethersulphates, such as the sodium salt of sulphated $C_{13}$–$C_{15}$ linear primary alcohol, condensed with 3 moles of ethylene oxide or of sulphated $C_{12}$–Chd 15 liner primary alcohol, condensed with 3 moles of ethylene oxide, or of sulphated $C_{12}$–$C_{14}$ primary alcohol, condensed with 2 moles of ethylene oxide.

In general, the amount of ternary active detergent mixture used in the present invention ranges from 0.5–5% by weight of the total composition, preferably from 0.5 to 3% by weight of the total composition.

The weight ratio of the three different detergent-active materials in the thickening system may vary widely; if A and B represent the detergent active materials of the binary system which would produce a liquid thickened composition with a decaying viscosity on storage and if C represents the anionic synthetic detergent of the sulphate or sulphonate type, the weight ratio of A:B can range from 20:80 to 95:5 and the weight ratio of (A+B):C can range from 60:40 to 90:10. Typically, when A is a soap, B is a tertiary amine oxide and C is an alkylethersulphate. Optimum results are obtained when A:B:C=(10–15):(65–70):(15–25).

The products of the invention have an improved viscosity stability over prolonged periods of storage, also at increased storage temperature. Their chlorine stability is not adversely affected by the ternary active detergent thickening system and remains comparable to that obtained with a binary active detergent thickening system. The cloud point of the products of the invention can be regulated by adjusting the total amount of the ternary active detergent thickening agent and/or addition of electrolytes to the composition, such as NaOH, NaCl, sodium silicate, buffer salts and the like.

The compositions of the invention may furthermore contain low levels of the usual additives in hypochlorite compositions such as hypochlorite-soluble and -stable colorants and perfumes. The compositions are useful for all bleaching purposes, especially for bleaching hard surfaces such as toilets, tiles, floors, kitchen sinks, etc. The compositions usually contain from 1–15% available chlorine. Their viscosity usually ranges from 10–200 cS at 25° C.

The invention will further be illustrated by way of example.

EXAMPLE 1

Various thickened liquid alkali metal hypochlorite compositions were prepared according to the following formulation:

| | % by weight | |
|---|---|---|
| Lauric acid | a | * |
| Lauryldimethylamine oxide | b | * |
| Sodium salt of sulphated $C_{13}$–$C_{15}$ linear primary alcohol, condensed with 3 moles of ethylene oxide | c | |
| Sodium hydroxide | d | |
| Sodium silicate (120° Twaddell) | 0.093 | |
| Perfume | 0.06 | |
| Sodium hypochlorite | 7.00 | ** |
| Water to | 100.00 | |

*expressed as relative weight percentage of total of a + b + c (=TAD)
**expressed as available chlorine The relative weight ratio of a:b:c was 10:70:20; the total amount of a+b+c (=TAD) was varied; the amount of d was dependent on the level of free NaOH required as well as on the amount of lauric acid and sodium hypochlorite.

Viscosity and cloud point measurements were carried out at room temperature, at 28° C. and at 37° C. at various intervals in time.

Table II represents the results obtained.

EXAMPLE 2

Example 1 was repeated, but with varying relative weight ratios of a:b:c and with varying TAD content. Table II represents the results of the viscosity measurements.

EXAMPLE 3

For control purposes, Example 1 was repeated but with (a+b) only. Table III represents the results obtained.

TABLE I

| | | | Viscosity in cS at given temperatures after given storage time | | | | | | | | | | | |
|---|---|---|---|---|---|---|---|---|---|---|---|---|---|---|
| FORMULATION: a:b:c = 10:70:20 | | | | | | | | | | | | | | |
| TAD | Free NaOH | Initial Viscosity | Age (days) | R/T | 28° C. | 37° C. | Age (days) | R/T | 28° C. | 37° C. | Age (days) | R/T | 28° C. | 37° C. |
| 2.1 | 1.5 | 41 | 18 | 48 | 45 | 40 | 39 | 49 | / | 39 | 61 | 50 | / | 38 |
| 2.5 | 1.35 | 40 | 16 | 49 | 46 | 45 | 37 | 51 | 49 | 45 | 59 | 52 | 52 | 44 |
| 2.0 | 1.8 | 39 | 15 | 43 | 39 | 35 | 36 | 46 | 40 | 37 | 58 | 46 | 41 | 37 |
| 2.6 | 1.0 | 40 | 14 | 48 | 39 | 46 | 35 | 49 | 48 | 42 | 57 | 48 | 52 | * |
| | | | 82 | 49 | / | 34 | 107 | 41 | / | 31 | 130 | 41 | / | – |
| | | | 80 | 52 | 55 | 40 | 105 | 46 | 54 | * | 128 | 44 | 48 | – |
| | | | 79 | 41 | 45 | 36 | 104 | 39 | 44 | 31 | 127 | 39 | 39 | – |
| | | | 78 | 44 | 54 | – | 103 | 50 | 56 | – | 126 | – | – | – |
| | | | Cloud point (in °C.) | | | | | | | | | | | |
| TAD | Free NaOH | Initial Cloud Pt. | Age (days) | R/T | 28° C. | 37° C. | Age (days) | R/T | 28° C. | 37° C. | Age (days) | R/T | 28° C. | 37° C. |
| 2.1 | 1.5 | 58 | 18 | 69 | 71 | 74 | 39 | 70 | / | 76 | 61 | 70 | / | 71 |
| 2.5 | 1.35 | 67 | 16 | + | + | + | 37 | + | + | + | 59 | 69 | + | + |
| 2.0 | 1.8 | 53 | 15 | 64 | 68 | 70 | 36 | 66 | 70 | 71 | 58 | 65 | 50 | 70 |
| 2.6 | 1.0 | 70 | 14 | + | + | + | 35 | + | + | + | 57 | 60 | 65 | * |
| | | | 82 | 70 | / | 75 | 107 | 69 | / | + | 130 | 73 | / | – |
| | | | 80 | 72 | + | + | 105 | + | + | * | 128 | + | + | – |
| | | | 79 | 65 | 66 | 73 | 104 | 69 | 67 | + | 127 | + | 72 | – |
| | | | 78 | + | 74 | – | 103 | 72 | + | – | 126 | 75 | 75 | – |

KEY
/ = Sample lost
* = Unstable
– = No measurement
+ = Greater than 80° C.

TABLE II

| | | | | | | Viscosity in cS at given temperatures after given storage time | | | | | | | | | | | |
|---|---|---|---|---|---|---|---|---|---|---|---|---|---|---|---|---|---|
| ACTIVE wt. % RATIO | | | | | | | Temp. (°C.) | | | | Temp. (°C.) | | | | Temp. (°C.) | | |
| a | b | c | TAD | Free NaOH | Init. Visc. | Age (days) | R/T | 28 | 37 | Age (days) | R/T | 28 | 37 | Age (days) | R/T | 38 | 37 |
| 05 | 65 | 30 | 2.5 | 1.5 | 41 | 19 | 47 | 48 | 48 | 34 | 48 | 51 | 51 | 56 | 49 | 59 | 52 |
| 10 | 65 | 25 | 1.5 | 1.5 | 35 | 14 | 36 | 34 | 31 | 28 | 37 | 36 | 33 | 51 | 39 | 40 | 33 |

TABLE II-continued

| | | | | | | | | | | | | | | | | | |
|---|---|---|---|---|---|---|---|---|---|---|---|---|---|---|---|---|---|
| 05 | 70 | 25 | 2.2 | 1.8 | 17 | 12 | 24 | 25 | 23 | 27 | 26 | 28 | 26 | 50 | 31 | 32 | 28 |
| 05 | 70 | 25 | 2.9 | 1.9 | 26 | 12 | 39 | 35 | 36 | 27 | 42 | 38 | 37 | 50 | 43 | 47 | 37 |
| 15 | 70 | 15 | 1.7 | 1.5 | 40 | 22 | 40 | 40 | 33 | 36 | 40 | 41 | 37 | 55 | 40 | 44 | 37 |
| 15 | 70 | 15 | 2.1 | 1.0 | 37 | 11 | 48 | 47 | 44 | 30 | 45 | 46 | 40 | 45 | 47 | 46 | 36 |
| 05 | 65 | 30 | 2.5 | 1.5 | 41 | 75 | 51 | 55 | 51 | 97 | 47 | 60 | 47 | | | | |
| 10 | 65 | 25 | 1.5 | 1.5 | 35 | 74 | 39 | 41 | 31 | 95 | 39 | 38 | 30 | | | | |
| 05 | 70 | 25 | 2.2 | 1.8 | 17 | 73 | 35 | 34 | 26 | 94 | 39 | 68 | 25 | | | | |
| 05 | 70 | 25 | 2.9 | 1.9 | 26 | 73 | 44 | 48 | 37 | 94 | 46 | 80 | 36 | | | | |
| 15 | 70 | 15 | 1.7 | 1.5 | 40 | 70 | 40 | 48 | 37 | 92 | 40 | 56 | 36 | | | | |
| 15 | 70 | 15 | 2.1 | 1.0 | 37 | 67 | 46 | 55 | 33 | 86 | 45 | 48 | / | | | | |
| 20 | 70 | 10 | 1.25 | 1.5 | 40 | 13 | 43 | 41 | 37 | 32 | 37 | 37 | 28 | 47 | 36 | 36 | 24 |
| 20 | 70 | 10 | 1.5 | 1.0 | 38 | 12 | 46 | 46 | 40 | 31 | 38 | 43 | 29 | 46 | 38 | 41 | 25 |
| 05 | 75 | 20 | 3.0 | 1.8 | 16 | 19 | 22 | 22 | 22 | 34 | 24 | 23 | 24 | 56 | 26 | 25 | 28 |
| 10 | 75 | 15 | 3.0 | 1.5 | 29 | 19 | 40 | 37 | 39 | 34 | 42 | 41 | 40 | 56 | 45 | 49 | 61 |
| 15 | 75 | 10 | 2.0 | 1.5 | 26 | 19 | 35 | 32 | 30 | 34 | 35 | 32 | 30 | 56 | 33 | 32 | 30 |
| 20 | 70 | 10 | 1.25 | 1.5 | 40 | 69 | 33 | 36 | 17 | 89 | / | 27 | / | | | | |
| 20 | 70 | 10 | 1.5 | 1.0 | 38 | 68 | 33 | 32 | 17 | 88 | / | 27 | 14 | | | | |
| 05 | 75 | 20 | 3.0 | 1.8 | 16 | 75 | 26 | 26 | 31 | 97 | 34 | 27 | 34 | | | | |
| 10 | 75 | 15 | 3.0 | 1.5 | 29 | 75 | 47 | 43 | 37 | 97 | 33 | 42 | 33 | | | | |
| 15 | 75 | 10 | 2.0 | 1.5 | 26 | 75 | 33 | 30 | 23 | 97 | 20 | 27 | 20 | | | | |

| ACTIVE wt. % RATIO | | | | | Cloud point (in °C.) | | | | | | | | | | | | |
|---|---|---|---|---|---|---|---|---|---|---|---|---|---|---|---|---|---|
| | | | | Free | Init. Cloud | Age | Temp. (°C.) | | | Age | Temp. (°C.) | | | Age | Temp. (°C.) | | |
| a | b | c | TAD | NaOH | Point | (days) | R/T | 28 | 37 | (days) | R/T | 28 | 37 | (days) | R/T | 38 | 37 |
| 05 | 65 | 30 | 2.5 | 1.5 | 62 | 19 | 67 | 64 | 65 | 34 | 67 | 67 | 66 | 56 | 70 | 69 | 69 |
| 10 | 65 | 25 | 1.5 | 1.5 | 46 | 14 | 58 | 55 | 58 | 28 | 55 | 55 | 57 | 51 | 56 | 54 | 59 |
| 05 | 70 | 25 | 2.2 | 1.8 | 66 | 12 | 73 | 69 | 73 | 27 | 72 | 70 | 72 | 50 | 73 | 70 | 73 |
| 05 | 70 | 25 | 2.9 | 1.9 | 74 | 12 | + | + | + | 27 | + | + | + | 50 | + | + | + |
| 15 | 70 | 15 | 1.7 | 1.5 | 54 | 22 | 67 | 68 | 68 | 36 | 74 | 70 | 74 | 55 | 74 | 69 | 73 |
| 15 | 70 | 15 | 2.1 | 1.0 | 71 | 11 | 73 | 68 | 81 | 30 | + | 80 | 84 | 45 | + | + | + |
| 05 | 65 | 30 | 2.5 | 1.5 | 62 | 75 | 69 | 67 | 68 | 97 | 69 | 65 | 69 | | | | |
| 10 | 65 | 25 | 1.5 | 1.5 | 46 | 74 | 54 | 52 | 58 | 95 | 54 | 53 | 57 | | | | |
| 05 | 70 | 25 | 2.2 | 1.8 | 66 | 73 | 72 | 70 | 74 | 94 | 72 | 68 | 74 | | | | |
| 05 | 70 | 25 | 2.9 | 1.9 | 74 | 73 | + | + | + | 94 | + | + | + | | | | |
| 15 | 70 | 15 | 1.7 | 1.5 | 54 | 70 | 73 | 66 | 73 | 92 | 70 | 68 | 72 | | | | |
| 15 | 70 | 15 | 2.1 | 1.0 | 71 | 67 | + | + | + | 86 | + | + | / | | | | |
| 20 | 70 | 10 | 1.25 | 1.5 | 45 | 13 | 54 | 56 | 59 | 32 | 59 | 59 | 65 | 47 | 60 | 59 | 66 |
| 20 | 70 | 10 | 1.5 | 1.0 | 59 | 12 | 64 | 67 | 72 | 31 | 71 | 67 | 75 | 46 | + | + | + |
| 05 | 75 | 20 | 3.0 | 1.8 | + | 19 | + | + | 70 | 34 | + | + | + | 56 | + | + | + |
| 10 | 75 | 15 | 3.0 | 1.5 | + | 19 | + | + | + | 34 | + | + | + | 56 | + | + | + |
| 15 | 75 | 10 | 2.0 | 1.5 | + | 19 | + | + | 74 | 34 | + | + | + | 56 | + | + | + |
| 20 | 70 | 10 | 1.25 | 1.5 | 45 | 69 | 68 | 61 | 72 | 89 | 65 | 61 | / | | | | |
| 20 | 70 | 10 | 1.5 | 1.0 | 59 | 68 | 76 | 73 | + | 88 | 72 | 77 | + | | | | |
| 05 | 75 | 20 | 3.0 | 1.8 | + | 75 | + | + | + | 97 | + | + | + | | | | |
| 10 | 75 | 15 | 3.0 | 1.5 | + | 75 | + | + | + | | | | | | | | |
| 15 | 75 | 10 | 2.0 | 1.5 | + | 75 | + | + | + | 97 | + | + | + | | | | |

TABLE III

| ACTIVE wt. % RATIO | | | | | Viscosity in cS at given temperatures after given storage time | | | | | | | | | | | | |
|---|---|---|---|---|---|---|---|---|---|---|---|---|---|---|---|---|---|
| | | | | Free | Init. | Age | Temp. (°C.) | | | Age | Temp. (°C.) | | | Age | Temp. (°C.) | | |
| a | b | c | TAD | NaOH | Visc. | (days) | R/T | 28 | 37 | (days) | R/T | 28 | 37 | (days) | R/T | 38 | 37 |
| 24.7 | 75.3 | – | 1.45 | 1.0 | 39 | 10 | 41 | 40 | 34 | 31 | 29 | 33 | 24 | 52 | 24 | 28 | 14 |
| 23.2 | 76.8 | – | 1.72 | 1.0 | 39 | 9 | 52 | 48 | 41 | 30 | 38 | 40 | 29 | 51 | 31 | 34 | 19 |
| 24.7 | 75.3 | – | 1.45 | 1.0 | 39 | 74 | 19 | 22 | 12 | 99 | 14 | 15 | 9 | 122 | 15 | 14 | |
| 23.2 | 76.8 | – | 1.72 | 1.0 | 39 | 73 | 26 | 29 | 16 | 98 | 19 | 20 | 12 | 121 | 17 | 18 | |

| | | | | | Cloud point (in °C.) | | | | | | | | | | | | |
|---|---|---|---|---|---|---|---|---|---|---|---|---|---|---|---|---|---|
| | | | | Free | Init. Cloud | Age | Temp. (°C.) | | | Age | Temp. (°C.) | | | Age | Temp. (°C.) | | |
| a | b | c | TAD | NaOH | Point | (days) | R/T | 28 | 37 | (days) | R/T | 28 | 37 | (days) | R/T | 38 | 37 |
| 24.7 | 75.3 | – | 1.45 | 1.0 | 64 | 10 | 84 | + | + | 31 | + | + | + | 52 | + | + | + |
| 23.2 | 76.8 | – | 1.72 | 1.0 | 75 | 9 | + | + | + | 30 | + | + | + | 51 | 51 | + | + |
| 24.7 | 75.3 | – | 1.45 | 1.0 | 64 | 74 | + | + | + | 99 | + | + | + | 122 | + | + | |
| 23.2 | 76.8 | – | 1.72 | 1.0 | 75 | 73 | 55 | + | + | 98 | + | + | + | 121 | + | + | |

EXAMPLE 4

Formulations were prepared of the type as described in Example 1, but with different thickening systems. The following Tables IV–IX specify the constituents of the thickening system qualitatively as well as quantitatively, and represent the results of the viscosity and cloud point measurements on these formulations. In Tables IV–VI the same system as in Example 3 was used for comparison purposes.

TABLE IV

| ACTIVE wt. % | Viscosity in cS at given temperatures after given storage time |
|---|---|

TABLE IV-continued

| RATIO a | b | c | TAD | Free NaOH | Init. Visc. | Age (days) | Temp. (°C.) R/T | 28 | 37 | Age (days) | Temp. (°C.) R/T | 28 | 37 | Age (days) | Temp. (°C.) R/T | 38 | 37 |
|---|---|---|---|---|---|---|---|---|---|---|---|---|---|---|---|---|---|
| 10 | 70 | 20 | 2.4 | 1.5 | 43 | 14 | 46 | 44 | 39 | 30 | 46 | 42 | 31 | 51 | 48 | 44 | 33 |
| 15 | 70 | 15 | 1.7 | 1.5 | 38 | 14 | 38 | 37 | 31 | 30 | 39 | 35 | 28 | 51 | 40 | 33 | 24 |
| 10 | 70 | 20 | 2.4 | 1.5 | 43 | 72 | 51 | 44 | 30 | 93 | 47 | 41 | 27 | 114 | 48 | — | — |
| 15 | 70 | 15 | 1.7 | 1.5 | 38 | 72 | 42 | 27 | 20 | 93 | 38 | 28 | 16 | 114 | 35 | 26 | 14 |

Cloud point (in °C.) at given temperatures after given storage time

| a | b | c | TAD | Free NaOH | Init. Cloud Point | Age (days) | Temp. (°C.) R/T | 28 | 37 | Age (days) | Temp. (°C.) R/T | 28 | 37 | Age (days) | Temp. (°C.) R/T | 38 | 37 |
|---|---|---|---|---|---|---|---|---|---|---|---|---|---|---|---|---|---|
| 10 | 70 | 20 | 2.4 | 1.5 | 66 | 14 | 76 | + | + | 30 | + | + | + | 51 | + | + | + |
| 15 | 70 | 15 | 1.7 | 1.5 | 56 | 14 | 67 | 74 | 80 | 30 | 72 | 76 | + | 51 | 73 | 77 | + |
| 10 | 70 | 20 | 2.4 | 1.5 | 66 | 72 | + | + | + | 93 | + | + | + | 114 | + | — | — |
| 15 | 70 | 15 | 1.7 | 1.5 | 56 | 72 | 71 | 78 | + | 93 | 75 | + | + | 114 | 70 | + | + |

a = lauric acid
b = lauryl dimethylamine oxide
c = sodium salt of sulphated $C_{12}$–$C_{15}$ linear primary alcohol, condensed with 3 moles of ethylene oxide

TABLE V

Viscosity in cS at given temperatures after given storage time

| ACTIVE wt. % RATIO a | b | c | TAD | Free NaOH | Init. Visc. | Age (days) | Temp. (°C.) R/T | 28 | 37 | Age (days) | Temp. (°C.) R/T | 28 | 37 | Age (days) | Temp. (°C.) R/T | 38 | 37 |
|---|---|---|---|---|---|---|---|---|---|---|---|---|---|---|---|---|---|
| 10 | 70 | 20 | 1.8 | 1.25 | 40 | 14 | 39 | 41 | 40 | 29 | 36 | 38 | 38 | 41 | 35 | 36 | 35 |
| 10 | 65 | 25 | 1.2 | 1.5 | 39 | 12 | 47 | 41 | 37 | 35 | 45 | 40 | 31 | 54 | 44 | 36 | 24 |
| 10 | 70 | 20 | 1.8 | 1.25 | 40 | 63 | 35 | 34 | 31 | 83 | 36 | 30 | 29 | | | | |
| 10 | 65 | 25 | 1.2 | 1.5 | 39 | 74 | 44 | 31 | 16 | 88 | 45 | 28 | 16 | 109 | 45 | 25 | 13 |

Cloud point (in °C.) at given temperatures after given storage time

| a | b | c | TAD | Free NaOH | Init. Cloud Point | Age (days) | Temp. (°C.) R/T | 28 | 37 | Age (days) | Temp. (°C.) R/T | 28 | 37 | Age (days) | Temp. (°C.) R/T | 38 | 37 |
|---|---|---|---|---|---|---|---|---|---|---|---|---|---|---|---|---|---|
| 10 | 70 | 20 | 1.8 | 1.25 | 57 | 14 | 70 | 71 | 70 | 29 | 76 | 76 | 74 | 41 | 77 | 77 | 73 |
| 10 | 65 | 25 | 1.2 | 1.5 | 32 | 12 | 39 | 47 | 49 | 35 | 46 | 49 | 50 | 54 | 46 | 48 | 53 |
| 10 | 70 | 20 | 1.8 | 1.25 | 57 | 63 | 79 | 78 | 72 | 83 | 77 | 77 | 71 | | | | |
| 10 | 65 | 25 | 1.2 | 1.5 | 32 | 74 | 47 | 49 | 57 | 88 | 45 | 51 | 59 | 109 | 44 | 47 | 66 |

a = lauric acid
b = lauryl dimethylamine oxide
c = sodium salt of sulphated $C_{12}$–$C_{14}$ primary alcohol, condensed with 2 miles of ethylene oxide

TABLE VI

Viscosity in cS at given temperature after given storage time

| ACTIVE wt. % RATIO a | b | c | TAD | Free NaOH | Init. Visc. | Age (days) | Temp. (°C.) R/T | 28 | 37 | Age (days) | Temp. (°C.) R/T | 28 | 37 | Age (days) | Temp. (°C.) R/T | 38 | 37 |
|---|---|---|---|---|---|---|---|---|---|---|---|---|---|---|---|---|---|
| 20 | 80 | 10 | 1.63 | 1.5 | 45 | 14 | 43 | 41 | 34 | 26 | 42 | 34 | 29 | 40 | 35 | 38 | 21 |
| 10 | 80 | 10 | 1.63 | 1.5 | 45 | 62 | 36 | 31 | 18 | 83 | 48 | 27 | 16 | 101 | 47 | 27 | 15 |

Cloud point (in °C.) at given temperatures after given storage time

| a | b | c | TAD | Free NaOH | Init. Cloud Point | Age (days) | Temp. (°C.) R/T | 28 | 37 | Age (days) | Temp. (°C.) R/T | 28 | 37 | Age (days) | Temp. (°C.) R/T | 38 | 37 |
|---|---|---|---|---|---|---|---|---|---|---|---|---|---|---|---|---|---|
| 10 | 80 | 10 | 1.63 | 1.5 | 53 | 14 | 63 | 67 | 72 | 29 | 64 | 74 | 72 | 40 | 71 | 67 | 68 |
| 10 | 80 | 10 | 1.63 | 1.5 | 53 | 62 | 73 | 79 | + | 83 | 67 | 77 | + | 101 | 65 | 77 | + |

a = lauric acid
b = lauryl dimethylamine oxide
c = sodium dodecyl sulphate

TABLE VII

Viscosity in cS at given temperatures after given storage time

| ACTIVE wt. % RATIO a | b | c | TAD | Free NaOH | Init. Visc. | Age (days) | Temp. (°C.) R/T | 28 | 37 | Age (days) | Temp. (°C.) R/T | 28 | 37 | Age (days) | Temp. (°C.) R/T | 38 | 37 |
|---|---|---|---|---|---|---|---|---|---|---|---|---|---|---|---|---|---|
| 60 | 40 | 0 | 3.0 | 1.5 | 41 | 14 | 46 | 32 | 28 | 28 | 33 | 31 | 19 | 50 | 34 | 30 | 17 |
| 50 | 40 | 10 | 3.0 | 1.5 | 41 | 14 | 38 | 33 | 30 | 28 | 33 | 32 | 28 | 47 | 38 | 33 | 24 |
| 60 | 40 | 0 | 3.0 | 1.5 | 41 | 71 | 29 | 30 | 15 | 90 | 33 | 22 | 12 | | | | |
| 50 | 40 | 10 | 3.0 | 1.5 | 41 | 68 | 38 | 38 | 25 | 82 | 38 | 36 | 20 | | | | |

Cloud point (in °C.) at given temperatures after given storage time

| Free | Init. Cloud | Age | Temp. (°C.) | Age | Temp. (°C.) | Age | Temp. (°C.) |
|---|---|---|---|---|---|---|---|

TABLE VII-continued

| a | b | c | TAD | NaOH | Point | (days) | R/T | 28 | 37 | (days) | R/T | 28 | 37 | (days) | R/T | 38 | 37 |
|---|---|---|---|---|---|---|---|---|---|---|---|---|---|---|---|---|---|
| 60 | 40 | 0 | 3.0 | 1.5 | + | 14 | + | + | + | 28 | + | + | + | 50 | + | + | + |
| 50 | 40 | 10 | 3.0 | 1.5 | + | 14 | + | + | + | 28 | + | + | + | 47 | + | + | + |
| 60 | 40 | 0 | 3.0 | 1.5 | + | 71 | + | + | + | 90 | + | + | + | | | | |
| 50 | 40 | 10 | 3.0 | 1.5 | + | 68 | + | + | + | 82 | + | + | + | | | | |

a = sodium lauroyl sarcosinate
b = lauryl dimethylamine oxide
c = sodium salt of $C_{13}$–$C_{15}$ linear primary alcohol, condensed with 3 moles of ethylene oxide

TABLE VIII

| ACTIVE wt. % RATIO | | | | Viscosity in cS at given temperature after given storage time | | | | | | | | | | | | | |
|---|---|---|---|---|---|---|---|---|---|---|---|---|---|---|---|---|---|
| | | | | Free | Init. | Age | Temp. (°C.) | | | Age | Temp. (°C.) | | | Age | Temp. (°C.) | | |
| a | b | c | TAD | NaOH | Visc. | (days) | R/T | 28 | 37 | (days) | R/T | 28 | 37 | (days) | R/T | 28 | 37 |
| 15 | 75 | 10 | 1.3 | 1.5 | 40 | 20 | 49 | 44 | 28 | 34 | 44 | 31 | 23 | 55 | 32 | 25 | 21 |
| 15 | 75 | 10 | 1.3 | 1.5 | 40 | 84 | 36 | 22 | 16 | 106 | 27 | 18 | 12 | 132 | 23 | 18 | 11 |
| | | | | Cloud point (in °C.) at given temperatures after given storage time | | | | | | | | | | | | | |
| | | | | Free | Init. Cloud | Age | Temp. (°C.) | | | Age | Temp. (°C.) | | | Age | Temp. (°C.) | | |
| a | b | c | TAD | NaOH | Point | (days) | R/T | 28 | 37 | (days) | R/T | 28 | 37 | (days) | R/T | 28 | 37 |
| 15 | 75 | 10 | 1.3 | 1.5 | 40 | 20 | 44 | 51 | 61 | 34 | 48 | 61 | 61 | 55 | 59 | 65 | 57 |
| 15 | 75 | 10 | 1.3 | 1.5 | 40 | 84 | — | 65 | 60 | 106 | 63 | 71 | 65 | 132 | 64 | 65 | 51 |

a = lauric acid
b = lauryl dimethylamine oxide
c = $C_{13-17}$ random secondary alkane sulphonate, sodium salt

TABLE IX

| ACTIVE wt. % RATIO | | | | Viscosity in cS at given temperatures after given storage time | | | | | | | | | | | | | |
|---|---|---|---|---|---|---|---|---|---|---|---|---|---|---|---|---|---|
| | | | | Free | Init. | Age | Temp. (°C.) | | | Age | Temp. (°C.) | | | Age | Temp. (°C.) | | |
| a | b | c | TAD | NaOH | Visc. | (days) | R/T | 28 | 37 | (days) | R/T | 28 | 37 | (days) | R/T | 28 | 37 |
| 10 | 80 | 10 | 1.45 | 1.5 | 42 | 20 | 48 | 42 | 23 | 34 | 43 | 40 | 27 | 55 | 39 | 28 | 22 |
| 10 | 80 | 10 | 1.45 | 1.5 | 42 | 84 | 35 | 30 | 17 | 106 | 28 | 22 | 18 | 132 | 26 | 26 | 14 |
| | | | | Cloud point (in °C.) at given temperatures after given storage time | | | | | | | | | | | | | |
| | | | | Free | Init. Cloud | Age | Temp. (°C.) | | | Age | Temp. (°C.) | | | Age | Temp. (°C.) | | |
| a | b | c | TAD | NaOH | Point | (days) | R/T | 28 | 37 | (days) | R/T | 28 | 37 | (days) | R/T | 28 | 37 |
| 10 | 80 | 10 | 1.45 | 1.5 | 38 | 20 | 45 | 48 | 57 | 34 | 47 | 51 | 66 | 55 | 51 | 59 | 56 |
| 10 | 80 | 10 | 1.45 | 1.5 | 38 | 84 | 54 | 56 | 56 | 106 | 58 | 63 | 58 | 132 | 59 | 52 | 57 |

a = lauric acid
b = lauryl dimethylamine oxide
c = $C_{10-12}$ benzene sulphonate, sodium salt

We claim:

1. A liquid, pourable, thickened bleaching composition having a viscosity of 10–200 cS at 25° C., consisting essentially of:

(i) an aqueous alkali metal hypochlorite solution in an amount such that the composition has an active chlorine content of 1–15% by weight;

(ii) from 0.5 to 5% by weight of a thickening agent consisting of:

(a) a sodium soap of a saturated $C_8$–$C_{18}$ fatty acid or an alkali metal sarcosinate of the formula $R_4CON(CH_3)COOM$, in which $R_4$ is a branched- or straight-chain $C_{10}$–$C_{18}$ alkyl group and M is an alkali metal cation;

(b) a tertiary amine oxide of the formula $R_1R_2R_3NO$ in which $R_1$ is a $C_8$–$C_{20}$ branched- or straight-chain alkyl group and $R_2$ and $R_3$ are branched- or straight-chain $C_1$–$C_4$ alkyl groups; and (c) a $C_{12}$–$C_{15}$ alkyl ether sulphate with 2–3 moles of ethylene oxide;

wherein the weight ratio of said saturated fatty soap or sarcosinate, tertiary amine oxide and alkyl ether sulphate is (10–15):(65–70):(15–25), the balance of the composition being essentially water, and all percentages being based upon the total weight of the composition.

* * * * *